US005271465A

United States Patent [19]

Schmidt et al.

[11] Patent Number: 5,271,465

[45] Date of Patent: Dec. 21, 1993

[54] OVER-PRESSURED WELL FRACTURING METHOD

[75] Inventors: Joseph H. Schmidt; James C. Abel; J. Lawrence Bacak, all of Anchorage; Dennis R. Reimers, Wasilla, all of Ak.; Ching H. Yew, Austin, Tex.

[73] Assignee: Atlantic Richfield Company, Los Angeles, Calif.

[21] Appl. No.: 874,159

[22] Filed: Apr. 27, 1992

[51] Int. Cl.[5] ..... F21B 43/26

[52] U.S. Cl. ..... 166/297; 166/308; 166/317; 166/372

[58] Field of Search ..... 166/297, 308, 317, 372

[56] References Cited

U.S. PATENT DOCUMENTS

| | | | |
|---|---|---|---|
| 2,740,478 | 4/1956 | Greene . | |
| 2,766,828 | 10/1956 | Rachford, Jr. | 166/308 |
| 3,170,517 | 2/1965 | Graham et al. . | |
| 3,190,357 | 6/1965 | Kirk | 166/317 X |
| 3,200,882 | 8/1965 | Allen . | |
| 3,393,741 | 5/1966 | Huitt et al. . | |
| 3,727,690 | 4/1973 | Munson | 166/308 X |
| 3,923,099 | 12/1975 | Brandon | 166/249 |
| 4,374,543 | 2/1983 | Richardson | 166/317 X |
| 4,633,951 | 1/1987 | Hill et al. | 166/308 |
| 4,683,943 | 8/1987 | Hill et al. | 166/63 |
| 4,718,493 | 1/1988 | Hill et al. | 166/308 |
| 4,823,875 | 4/1989 | Hill | 166/280 |
| 4,903,772 | 2/1990 | Johnson | 166/299 |
| 5,000,264 | 3/1991 | Snider | 166/372 |
| 5,005,649 | 4/1991 | Smith et al. | 166/308 |
| 5,131,472 | 7/1992 | Dees et al. | 166/308 |
| 5,205,360 | 4/1993 | Price | 166/308 |

OTHER PUBLICATIONS

SPE Paper No. 16894 "Perforating a High-Pressure Gas Well Overbalanced in Mud: Is It Really that Bad?" by Bundy, et al, 1987.

"The Multiwell Experiment—A Field Laboratory in Tight Gas Sandstone Reservoirs" by Northrop et al, Society of Petroleum Engineers, Jun. 1990, Journal of Petroleum Technology.

*Primary Examiner*—George A. Suchfield

*Attorney, Agent, or Firm*—Michael E. Martin

[57] ABSTRACT

Hydraulic fractures are initiated or extended into fluid-producing earth formations from a cased well by filling a space within the casing adjacent the formation zone of interest with liquid which extends into a tubing string and forming a pressure gas charged portion of the tubing string by introducing pressure gas or liquid into the tubing string to compress a column of gas therein to a pressure which exceeds the formation fracture breakdown pressure. By perforating the casing or, if perforations already exist, releasing a frangible disk type closure interposed in the tubing string, the gas charge in the tubing string forces fluid into the formation at sustained pressure and flow conditions not attainable by surface pumped fracture fluids.

13 Claims, 2 Drawing Sheets

OVER-PRESSURED WELL FRACTURING METHOD

BACKGROUND OF THE INVENTION

1. Field of the Invention

The present invention pertains to a fracturing method for hydraulically fracturing an earth formation from a wellbore by over-pressuring the wellbore tubing or casing with artificial lift gas or gas from another source so as to provide a high pressure/flow condition during fracture initiation or extension.

2. Background

In hydraulically fracturing earth formations to stimulate production of fluids therefrom, a long-standing problem has been the inability to sustain high pressure and flow of the fracturing fluid during fracture initiation or extension. In deviated wells, in particular, inadequate pressure/flow conditions at fracture initiation will produce a near wellbore kink in the fracture which will tend to restrict the flow of fluids to or from the wellbore once the fracture has been formed. U.S. Pat. No. 5,074,359, issued Dec. 24, 1991 to Joseph H. Schmidt and assigned to the assignee of the present invention discusses the problem of improper fracture formation from deviated wellbores, in particular. This patent is directed to a method for orienting the casing perforations to minimize improperly formed fractures at or near the perforations.

Conventional hydraulic fracturing is limited by the inability to provide the fracture fluid at sufficiently high flow rate to sustain the formation breakdown pressure once breakdown occurs. Since, in conventional fracturing techniques, the fracture fluid is supplied at the requisite pressure from surface disposed pumps, pressure losses through the pumping system and the wellbore conduits leading to the fracture zone often preclude adequate fracture extension once breakdown occurs, and the resultant pressure drop in the flow path often provides improperly formed or inadequately extended fractures. Certain methods have been developed with a view to overcoming this long-standing problem. U.S. Pat. 4,633,951 to Hill, et al suggests filling the well casing with a compressible hydraulic fracturing fluid comprising a mixture of liquid, compressed gas and proppant material and then igniting a gas generating unit in the wellbore to generate a rapid outflow of gas followed by a charge of gassy fracturing fluid. However, the Hill et al method may not be suitable for fracturing wells which have been previously perforated nor wells which are operated on artificial gas lift. In any case, it has been considered desirable to provide a less complicated and less expensive fracture initiation and extension technique which is provided by the method of the present invention.

SUMMARY OF THE INVENTION

The present invention provides a unique method of initiating or extending fractures in an earth formation through a wellbore by forcing a hydraulic fracturing fluid into the formation at or above formation breakdown pressure at a sustained flow rate to provide a fracture which will not pinch off or be kinked in the near wellbore region and which may be extended from the near wellbore region.

In accordance with an important aspect of the present invention, a unique fracturing method is provided which includes providing a charge of compressed gas in a well conduit which is in communication with the well casing in the region to be fractured prior to perforation of the casing or which conduit may be placed in communication with the casing in the region to be fractured if perforations already exist which open into the region to be fractured. The gas charge may be placed in the well conduit by first removing part of the liquid column already in the conduit such as by swabbing the well or displacing the liquid by injecting gas through coiled tubing or artificial lift valves in communication with the conduit and the wellbore casing. The gas pressure is then advantageously increased to a selected value by injection of liquid into the conduit to further compress an existing column of gas therein. Alternatively, the conduit may be precharged with gas from a pressure gas source at the surface.

In accordance with another aspect of the present invention, there is provided a unique method of initiating or extending fractures from wells which are configured for production through gas lift.

Still further in accordance with the present invention, there is provided a unique fracturing method utilizing a gas charge as a means of providing energy to propel hydraulic fluid into the formation at sustained periods of injection at or above formation breakdown pressure to provide a fracture which has a maximum radius of curvature away from the wellbore and which is not likely to pinch or kink.

Yet other aspects of the present invention comprise an improved fracturing method wherein stimulation of the formation region which is being fractured is carried out using acids or cross-linked fracturing fluids containing proppants as the so-called lead fluids which initiate or extend the fracture.

Those skilled in the art will recognize the above-described features and advantages of the present invention together with other superior aspects thereof upon reading the detailed description which follows in conjunction with the drawing.

DESCRIPTION OF PREFERRED EMBODIMENTS

Figure 1:
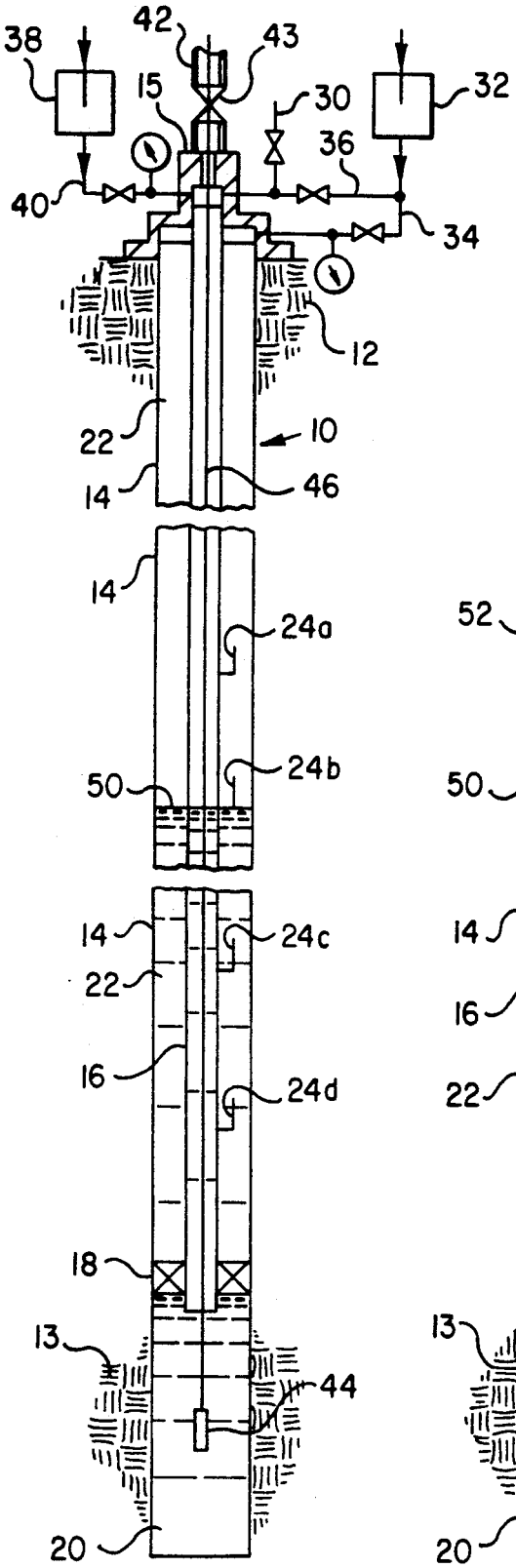
FIG. 1 is a schematic diagram of a well operated by artificial gas lift and operable to use the fracturing method of the present invention.

In the description which follows, like parts are marked throughout the specification and drawing with the same reference numerals, respectively. The drawing figures are in schematic form in the interest of clarity and conciseness.

Referring to FIG. 1, there is illustrated a well 10 which has been drilled into an earth formation 12 and is provided with a conventional casing 14, wellhead 15 and a tubing string 16 extending within the casing from the wellhead 15 to a point adjacent a zone 13 in the earth formation 12 from which fluids are to be produced. The zone 13 of the earth formation from which fluids are to be produced lies generally below a packer 18 which serves to pack off a space 20 in the casing 14 from an annular space 22 formed between the casing and the tubing string 16.

By way of example, the well 10 is adapted to produce fluids by artificial gas lift and several spaced apart conventional gas lift mandrels 24*a*, 24*b*, 24*c* and 24*d* are interposed in the tubing string 16 and are provided with conventional gas lift valves or so-called dummy valves, as needed. Accordingly, once the well 10 is placed in production, if reservoir pressure is not sufficient to force fluid up through the tubing string 16 to a flow line 30, fluid may be lifted by injecting gas into the annulus 22 to flow through selected ones of the gas lift mandrels 24 and into the tubing string 16 to lift the fluid within the tubing string in a well-known manner. However, the method of the present invention is not confined to use only with wells which are adapted for artificial gas lift. Pressure gas may be selectively supplied to the annular space 22 or to the interior of the tubing string 16 by way of a compressor 32 and suitable discharge flow lines 34 and 36 connected to the wellhead 15. The wellhead 15 is also configured to receive pressure fluid by way of a pump 38 and a discharge conduit 40 connected to the wellhead 15 for conducting certain liquids down through the interior of the tubing string 16 to the space 20.

The wellhead 15 is also configured to have a suitable wireline lubricator assembly 42 mounted thereon in a conventional manner and capable of being isolated from the interior of the tubing string 16 by a conventional wireline valve 43. The equipment just described comprising the packer 18, the gas lift mandrels 24, the wellhead 15 and the wireline lubricator 42 is conventional in the art of producing fluids from subterranean earth formations and is further described in *Products and Services Catalog No. OEC*5516 of the Otis Engineering Corporation, Dallas, Tex.

In the arrangement illustrated in FIG. 1, the well 10 has already been configured to prepare the zone 13 for perforation of the casing 14 and subsequent fracturing of the earth formation in the zone 13 to enhance the production of fluids from the formation into the well. In this regard, a conventional tubing or casing perforating tool or gun 44 is shown in its desired position within the space 20 connected to a suitable electric line 46 extending through the tubing string 16 from the wellhead 15.

The well 10 is also, in the configuration illustrated in FIG. 1, partially filled with liquid to a level indicated by numeral 50 or, in certain instances as described herein, completely filled with liquid to the wellhead 15. The liquid level is approximately the same in both the annulus 22 and in the interior of the tubing string 16. This liquid level could result from production of fluids from another zone within the well, purposeful introduction of the fluid into both the tubing string 16 and the annulus 22 or as a result of drilling and completion operations previously carried out prior to the operations to be described herein. In any case, the space 20 and the tubing string 16 are filled with liquid to the level 50 which is just below the gas lift mandrel 24*b* with reference to the top of the well as defined by the wellhead 15. In the arrangement of FIG. 1, the third and fourth gas lift mandrels 24*c* and 24*d*, from the top, are considered "dummy" mandrels, that is, the gas lift valves have been replaced with dummy valves which will not permit the introduction of lift gas into the tubing string 16 through the third and fourth mandrels.

In preparation for a fracturing operation to be carried out by the method of the present invention, liquid may be lifted out of the tubing string 16 by introduction of lift gas into the annulus 22 so that such gas will flow through the gas lift valves of the first and second mandrels 24*a* and 24*b* to lift liquid out of the tubing string 16 down to the level 50. This liquid may be produced out through the wellhead 15 and the flowline 30 before shut-off of a valve interposed therein.

Figure 2:
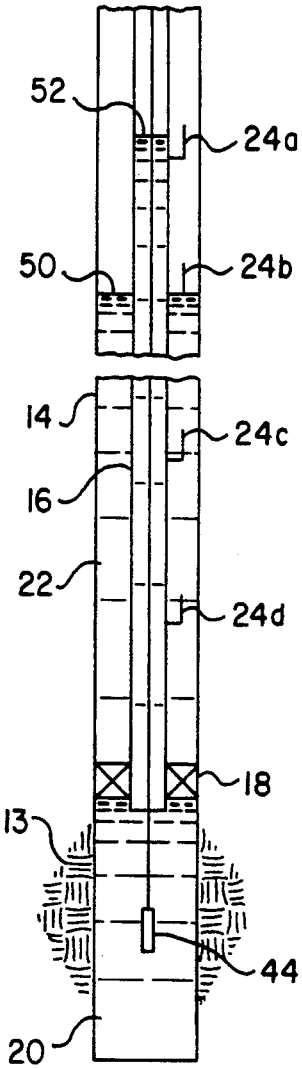
FIG. 2 is a partial diagram of the well of FIG. 1 showing the condition of the well just prior to fracture initiation.

In preparation for perforation of the casing 20 into the zone 13 and fracturing of the zone in accordance with the present invention, the space within the tubing string 16 between the level 50 and the wellhead 15 is filled with gas whose pressure is increased by pumping suitable liquid into the interior of the tubing string by way of the pump 38, the conduit 40 and the wellhead 15. Pumping liquid into the tubing string 16 will result in raising the liquid level in the tubing string to that indicated by numeral 52 in FIG. 2 which, as indicated, is above the previous fluid level 50. Pumping liquid into the tubing string 16 will raise the pressure of the gas in the tubing string between the liquid level 52 and the wellhead 15 since, it is assumed that valves interposed in the conduits 30 and 36 and the valve 43 are now closed. Once the gas pressure in the conduit 16 is raised to a preferred amount, the valve interposed in conduit 40 is shut, thereby isolating the gas in the tubing string at a substantial pressure. The liquid pressure in the space 20 and in the tubing string 16 below the liquid level 52 is, of course, raised accordingly. At least some of the liquid may be a suitable fracturing fluid such as an acid, or a crosslinked polymer type gel with a suitable amount of proppant dispersed therein.

Figure 3:
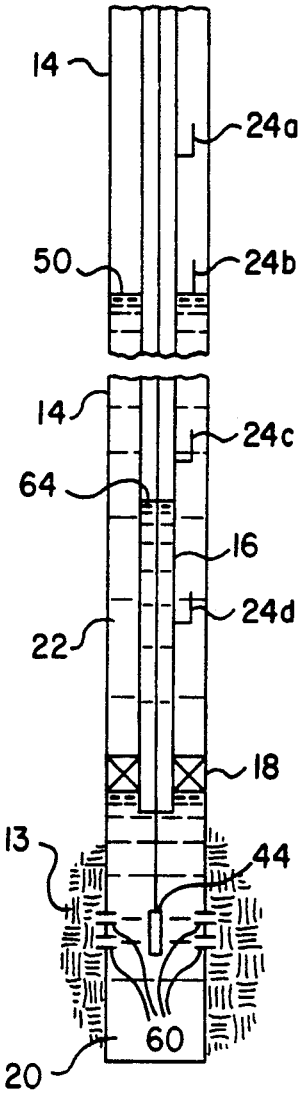
FIG. 3 is a partial diagram of the well of FIG. 1 showing the conditions in the well after fracture initiation.

Once a sufficient amount of fluid has been added to the interior of the tubing string 16 to increase the pressure within the tubing string to the desired amount, the perforating tool 44 is activated to form perforations 60, FIG. 3, in the casing 14 in a preferred pattern. Once the casing 14 has been perforated, liquid in the space 20 and in the tubing string 16 rushes through the perforations into the formation zone 13 at a pressure sufficient to break down the formation and form a suitable fracture extending either radially from the casing 14 or having the desired radius of curvature discussed in U.S. Pat. No. 5,074,359.

FIG. 3 indicates the condition of the well after perforation of the casing 14 and forming the fractures in the zone 13. The fluid level in the tubing string 16 has now dropped to that indicated by the numeral 64 since fluid has been forced out into the formation zone 13. Accordingly, by building pressure within the tubing string 16 and the space 20 prior to perforation of the casing 14 in the zone of interest to form a "gas accumulator" within the tubing, a sufficient volume of fracturing fluid is available in the space 20 and in the lower portions of the tubing string 16 to be propelled through the perforations 60 with sufficient pressure to exceed the formation breakdown pressure by an amount which will provide a suitable fracture. In this way, the fracture may be formed and extended without concern for fluid pressure losses which would be incurred in conventional fracturing operations where the fracture fluid is pumped all the way from the surface through the entire length of the tubing string 16.

By way of example, a well approximately 10,000 feet deep in a North Slope, Alaskan oil field having a casing 14 diameter of 9.62 inches and a tubing 16 diameter of 5.50 inches is prepared for perforation in an overbalanced condition with a clear fluid such as a methanol/-water mixture, "dead" crude oil or gelled water type fracturing fluid, for example. The fluid level 52 prior to perforation is at approximately the 6,000 foot level (measured from the surface) and the gas pressure in the tubing 16 above the fluid level 52 is raised to exceed the formation fracture or "breakdown" pressure at the zone of interest 13, which pressure is approximately 3,500 psig, measured at the surface. Upon perforation of the casing, through the tubing 16 and the space 20, the sustained high velocity flow of fluid into the perforations at a pressure exceeding the formation breakdown pressure will also cause approximately a 2,500 lb. drag force to be exerted on a 7/16 inch diameter electric line 46. Additionally, a 5,000 lb. force may be exerted on the cable head when the line 46 stretches after firing of the perforation tool 44.

Figure 4:
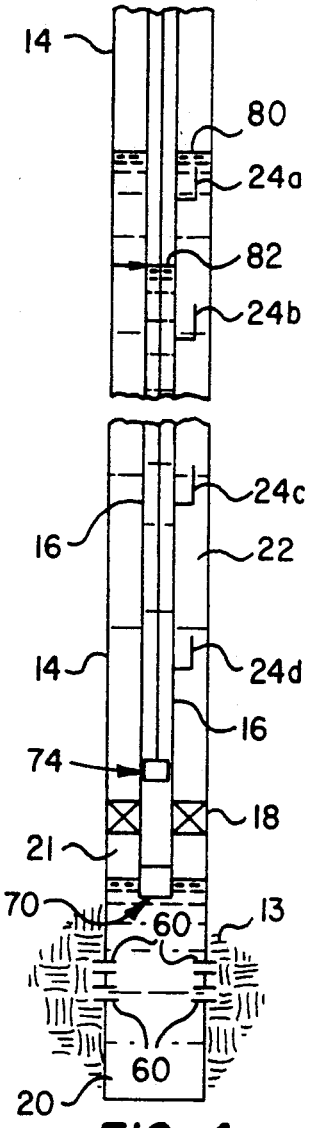
FIG. 4 is a schematic diagram of a well illustrating an alternate embodiment of the method of the invention.
Figure 5:
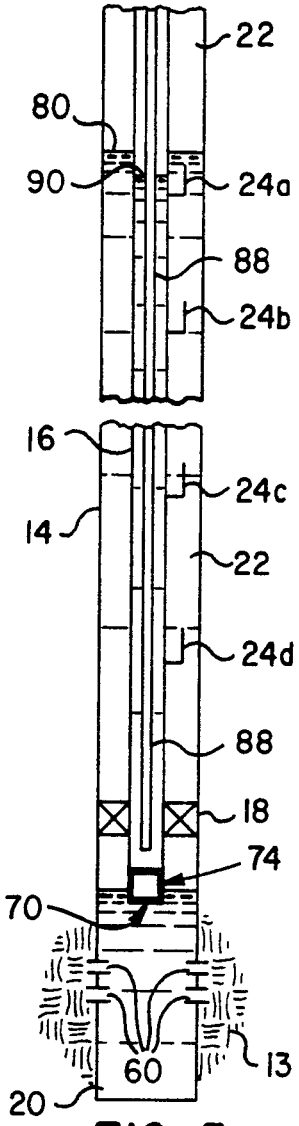
FIG. 5 is a partial diagram of the well of FIG. 4 showing the well conditions just prior to fracture initiation and extension.
Figure 6:
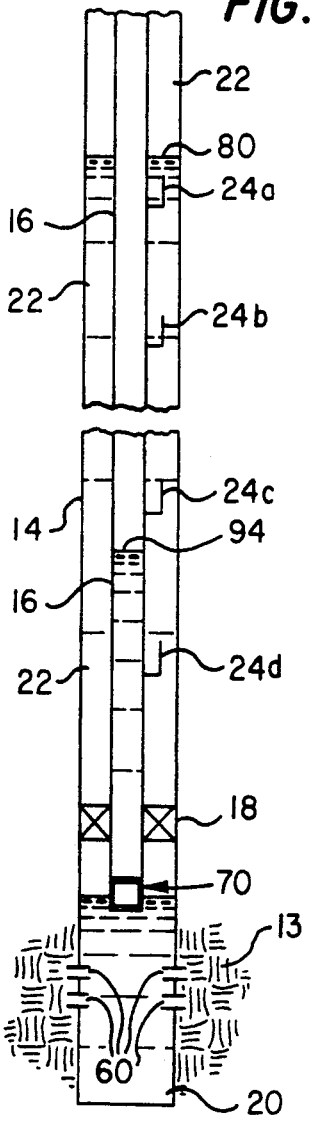
FIG. 6 is a diagram similar to FIGS. 4 and 5 showing the well conditions after completion of the fracture.

Referring now to FIGS. 4 through 6, an alternate method of the present invention is carried out utilizing essentially all of the elements described and illustrated in FIG. 1 and including a sub such as an Otis Engineering Company type XN landing nipple 70 connected to the lower end of the tubing string 16. The electric line 46 may be replaced with a wireline 72 which is adapted to lower into the tubing string 16 retrievable frangible closure means comprising a so-called rupture or shear disk assembly 74, see FIG. 7 also. The shear disk assembly 74 is lowered into engagement with the landing nipple 70 using conventional locking mechanism, not shown, to block fluid flow from within the tubing string 16 into the space 20.

Figure 7:
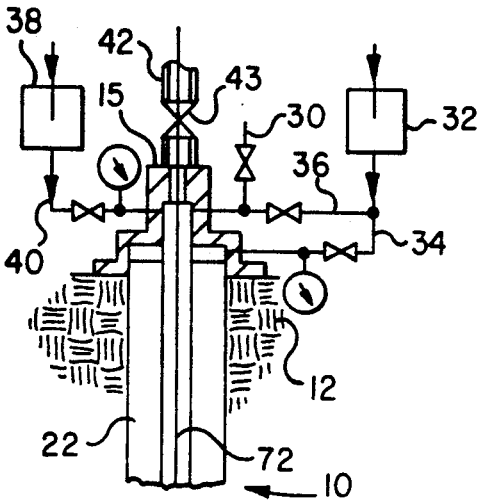
FIG. 7 is a section view of the shear disk and support body.
Figure 7:
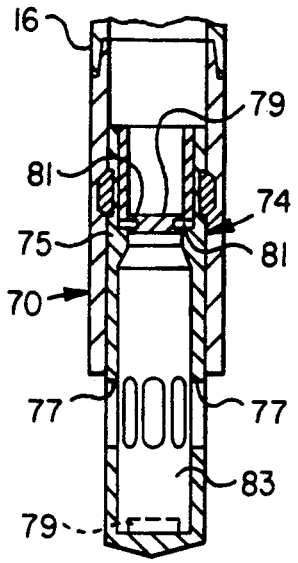

As shown in FIG. 7, the shear disk assembly 74 preferably includes a tubular body 75 having plural fluid exit ports 77 formed therein. The body 75 supports frangible closure means comprising a metal disk 79 by plural radially projecting shear pins 81, for example. The pins 81 shear under forces caused by a predetermined differential fluid pressure in the tubing string 16 acting across the disk 79 to displace the disk to the alternate position shown in FIG. 7 to permit fluid flow through ports 77 to space 20. The ruptured or displaced disk 79 is retained in a receptacle portion 83 of body 75.

In the arrangement illustrated in FIG. 4, the perforations 60 have already been formed and it is desired to extend fractures into the formation zone 13. Accordingly, pressure is allowed to accumulate in the tubing 16 until it is sufficient to shear the pins 81 and displace the shear disk 79 into the receptacle 83 whereupon a high velocity stream of fluid at high pressure is discharged from the lower portion of the tubing string 16 into the space 20 and through the perforations 60 to extend the fractures in the formation zone of interest 13. In some instances, there may be an accumulation of gas in a space 21, FIG. 4, between the packer 18 and the lower end of the tubing string 16 as delimited by the landing nipple 70. This accumulation of gas from prior production of fluid through the well 10 may result in some cushioning of the fracture process since some of the fluid flowing into space 20 from the tubing string 16 may flow into the space 21 compressing the gas trapped therein rather than through the perforations 60 and into the formation zone 13 to extend the fractures.

The well 10, in accordance with the method described and illustrated in FIGS. 4 through 7, may be prepared for fracturing the formation zone 13, or extending fractures already formed in zone 13, by forcing liquid already in the tubing string 16 down to a predetermined level. For example, viewing FIG. 4, if the well 10 had been previously on production and then shut in, the liquid level in both the annulus 22 and the tubing string 16 would possibly be at the level 80 indicated in FIG. 4. However, if pressure gas from the compressor 32 is forced into the tubing string 16 by way of the conduit 36, the liquid level in the tubing string may be decreased to that indicated by numeral 82. Hence, gas at supply pressure from the compressor 32 may be imposed on the liquid levels in the annulus 22 and in the tubing string 16. Alternatively, coilable tubing 88, FIG. 5, may be inserted in the tubing string 16 and used to blow liquid up out of the tubing string by introducing pressure gas into the tubing string through such coilable tubing. The well may also be "swabbed". After forcing the liquid level down to that indicated by numeral 82, the shear disk assembly 74 may be lowered by the wireline 72 and "set" or locked into the landing nipple 70. If the liquid level in tubing string 16 is lowered by blowing liquid out via the coilable tubing 88 or swabbing the tubing string 16 the shear disk assembly 74 may be set in place in the landing nipple 70 prior to such operation. Moreover, if it is contemplated that there will not be a sufficient amount of liquid in the tubing string 16 to be injected into the formation zone 13 through the space 20, the gas lift valves may be removed from the gas lift mandrel 24*a*, for example, for a purpose to be explained further herein. If the liquid to be introduced into the formation zone 13 during the fracture operation is a special fracturing fluid or acid, a quantity of such fluid may be "spotted" at the lower end of the tubing string 16 by injecting the desired quantity through coilable tubing string 88 in a conventional manner.

After spotting the amount of specialized fluid desired within the lower part of the tubing string 16, the coilable tubing string 88 is withdrawn and a suitable liquid may be pumped into the tubing string 16 by way of the pump 38 and the conduit 40 connected to wellhead 15. The valves interposed in conduits 30 and 36 would, of course, be closed during this fluid introduction process. As liquid is introduced into the tubing string 16, the liquid level will increase to that indicated by numeral 90, for example, FIG. 5, until the fluid pressure in the tubing string 16 is increased to the desired amount as controlled by the shear disk 74. Once the pressure increases to that which will effect failure of the pins 81, the shear disk 79 unblocks the tubing string 16 and liquid in the tubing string will rush with great velocity and pressure into the space 20 and out through the perforations 60 to extend or form fractures in the zone 13. The desired type of fluid disposed in the lower portions of the tubing string 16 as spotted there by the coilable tubing 88 will be thus be carried into the formation to enhance treatment of the zone of interest 13. It may be desirable to fill the annulus 22 completely to the wellhead 15 with liquid under pressure to minimize fluid-pressure-induced stress on the tubing string 16 and to reduce shock forces acting on the packer 18 due to the rapid pressure rise in the space 20.

Upon completion of the fracture method, the well 10 will be in the condition indicated in FIG. 6 with a tubing liquid level at 94. The annulus fluid level will be at 80 if the annulus 22 has not been filled completely with liquid prior to displacing the shear disk 79. If, as mentioned above, insufficient fluid is believed to be capable of being injected into the formation through the tubing string 16, removal of the gas lift valve from the mandrel 24a, for example, will allow some additional make-up fluid to flow from the annulus 22 through the mandrel 24a and into the tubing string 16 to provide a sufficient amount of injection fluid into the formation zone of interest. This will require sufficient gas pressure acting on the liquid in the annulus 22, of course.

As mentioned above, fluid suitable for introduction into the tubing string 16 may be the above-mentioned treatment fluids. Other fluids which are merely introduced to take up space may include water, methanol/-water mixtures, dead crude oil, diesel fuel and certain additives for each. Temperature conditions may dictate the type of liquid being injected into the tubing string 16.

Additional treating fluids may be injected into the formation after removing the shear disk body 75 from the tubing string 16, if desired.

Although preferred embodiments of the present invention have been described in detail herein, those skilled in the art will recognize that various substitutions and modifications may be made to the methods described without departing from the scope and spirit of the invention as recited in the appended claims.

What is claimed is:

1. A method for hydraulic fracturing an earth formation from a well extending from the surface into said formation, said well including a casing extending into a zone of interest in said formation and a tubing string extending within said casing and including at least one gas lift means interposed therein for admitting lift gas into said tubing string from said casing, comprising the steps of:

admitting lift gas into an annulus between said tubing string and said casing and through said gas lift means to lift liquid out of said tubing string until the liquid in said tubing string is reduced to a predetermined level from the surface;

closing off the flow of gas and liquid from said tubing string to trap a column of gas in said tubing string;

pumping liquid into said tubing string to increase the pressure of gas trapped in said tubing string; and causing liquid in said tubing string and in a space in said casing in communication with said tubing string to flow into said formation at a pressure sufficient to effect a hydraulic fracture in said zone of interest.

2. The method set forth in claim 1 wherein:

the step of causing said liquid to flow into said formation is carried out by perforating said casing at said zone of interest to provide a flow path for said liquid into said formation.

3. The method set forth in claim 1 including the step of:

introducing a quantity of liquid into said tubing string below said quantity of gas trapped in said tubing string and at a predetermined level in said tubing string so that such quantity of liquid is forced into said zone of interest.

4. The method set forth in claim 1 including the step of:

providing frangible means at a predetermined location in said tubing string, said frangible means being operable at a predetermined pressure to admit liquid into said space at a pressure sufficient to effect breakdown of said formation in said zone of interest; and raising the pressure of fluid in said tubing string to cause said frangible means to release fluid into said space and into said formation at said zone of interest.

5. The method set forth in claim 1 including the step of:

forcing liquid from said annulus into said tubing string under the urging of pressure gas in said annulus to supplement the liquid flow into said formation.

6. A method of extending a hydraulic fracture into a zone of interest in an earth formation having a well extending therein, said well including a wellhead, a casing extending to said zone of interest, a tubing string extending within said casing and means defining a space in said well in communication with said tubing string, comprising the steps of:

providing at least a portion of said tubing string charged with pressure gas;

placing frangible means in said tubing string at a predetermined point to block the flow of fluid from said tubing string to said space;

pumping liquid into said tubing sting between said frangible mean and said wellhead to increase the gas pressure in said tubing string a predetermined amount which is sufficient to cause said frangible means to place said tubing string in fluid flow communication with said space and which pressure is sufficient to extend a hydraulic fracture in said formation.

7. A method for forming or extending a fracture in an earth formation having a wellbore extending therewithin, said wellbore including a space defined in part by a casing, a tubing string extending within said casing and opening into said space, said tubing spring being operably connected to a wellhead, said space and said tubing string each being at least partially filled with liquid, said method comprising the steps of:

displacing at least some liquid from said tubing string to provide a portion of said tubing string filled with gas;

introducing liquid into said tubing string to compress gas in said portion of said tubing string to a pressure sufficient to extend a fracture form said wellbore into said formation; and perforating said casing to place liquid in said space in communication with said formation; and displacing liquid form said tubing string into said space under the urging of pressure gas in said portion of said tubing string to effect a fracture in said formation.

8. The method set forth in claim 7 wherein:

said well includes at least one lift gas valve interposed in said tubing string and means for introducing lift gas into an annulus formed between said tubing string and said casing, and the step of displacing liquid form said tubing string is carried out by conducting pressure gas through said annulus and said lift gas valve and into said tubing string to displace liquid from said tubing string and provide pressure gas in said portion of said tubing string between said space in said wellbore and said wellhead.

9. The method set forth in claim 7 including the step of:

filling an annulus between said casing and said tubing string with liquid to minimize pressure-induced stress on at least one of said tubing string and said packer.

10. A method for forming or extending a fracture in an earth formation having a wellbore extending therewithin, said wellbore including a space defined in part by a casing, a tubing string extending within said casing and opening into said space, said tubing string being operably connected to a wellhead, said space and said tubing string each being at least partially filled with liquid, said method comprising the steps of:

displacing at least some liquid from said tubing string to provide a portion of said tubing string filled with gas;

placing fluid flow blocking means in said tubing string at a predetermined point to block the flow of fluid form said tubing string into said space; and introducing liquid into said tubing string to compress gas in said portion of said tubing string to a predetermined pressure sufficient to cause said fluid flow blocking means to release pressure fluid into said space and to displace liquid form said tubing string into said space under the urging of pressure gas in said portion of said tubing string to extend a fracture form said wellbore into said formation.

11. The method set forth in claim 10 wherein:

liquid is displaced form said tubing string by introducing pressure gas into said tubing string though tubing means inserted in said tubing string.

12. The method set forth in claim 10 wherein:

liquid is displaced from said tubing string by swabbing said tubing string.

13. The method set forth in claim 10 including the step of:

causing the pressure in said tubing string and said space to decline to about the nominal pressure of said formation in communication with said space and removing said fluid flow blocking means from said tubing string after said fluid flow blocking means releases fluid from said tubing string at said predetermined pressure.

* * * * *